US006592258B2

(12) United States Patent
Chabin et al.

(10) Patent No.: US 6,592,258 B2
(45) Date of Patent: Jul. 15, 2003

(54) X-RAY EMISSION DEVICE AND METHOD OF ASSEMBLY

(75) Inventors: Eric Chabin, Montigny-le-Bretonneux (FR); Xavier Le Pennec, Trappes (FR)

(73) Assignee: GE Medical Systems Global Technology Company LLC, Waukesha, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/859,766

(22) Filed: May 17, 2001

(65) Prior Publication Data

US 2002/0018544 A1 Feb. 14, 2002

(30) Foreign Application Priority Data

May 19, 2000 (FR) ..... 00 06466

(51) Int. Cl.[7] ..... H05G 1/02
(52) U.S. Cl. ..... 378/195; 378/202

(58) Field of Search ..... 378/195, 199–202

(56) References Cited

U.S. PATENT DOCUMENTS

| | | | | |
|---|---|---|---|---|
| 2,829,271 A | * | 4/1958 | Boucher | 378/200 |
| 5,067,146 A | * | 11/1991 | Meinel et al. | 378/199 |
| 5,581,591 A | | 12/1996 | Burke et al. | 378/135 |

FOREIGN PATENT DOCUMENTS

| | | |
|---|---|---|
| DE | 19824008 | * 12/1999 |
| EP | 351225 | 1/1990 |
| EP | 456539 | * 11/1991 |
| EP | 972490 | 1/2000 |
| WO | 9744809 | 11/1997 |

* cited by examiner

*Primary Examiner*—Craig E. Church
(74) *Attorney, Agent, or Firm*—Jay L. Chaskin

(57) ABSTRACT

X-ray emission device comprising a casing opened by a window and an X-ray tube placed in the casing, the tube comprising an anode assembly equipped with an anode, a cathode assembly equipped with a cathode and an envelope containing the anode and the cathode, the anode assembly including a means of longitudinal positioning of the tube in the casing and the cathode assembly including a means of angular positioning of the tube in the casing on a longitudinal axis.

27 Claims, 4 Drawing Sheets

X-RAY EMISSION DEVICE AND METHOD OF ASSEMBLY

CROSS REFERENCE TO RELATED APPLICATIONS

This application claims the benefit of a priority under 35 USC 119 to French Patent Application No. 0006466 filed May 19, 2000, the entire contents of which are incorporated by reference.

BACKGROUND OF THE INVENTION

The present invention concerns the field of radiology apparatus and, in particular, the assembly of such an apparatus.

A radiology apparatus used, for example, in mammography, RAD or RF conventional radiology and neurological or even vascular (peripheral or cardiac) radiology generally comprises: an X-ray tube and a collimator for forming and delimiting an X-ray beam; an image receiver, generally a radiological image intensifier and a video camera, or even a solid-state detector; a positioner carrying the X-ray tube and collimator assembly on one side and image receiver on the other, movable in space on one or more axes; and a table for supporting a patient. An example of such an apparatus is disclosed in EP-A-972,490, and the apparatus has use in X-ray imaging.

An X-ray tube mounted, for example, in a medical radiology apparatus comprises a cathode and an anode, both contained in a vacuum-tight envelope, for electric insulation between the two electrodes. The cathode produces an electron beam which is received by the anode on a small surface constituting a focus from which the X-rays are emitted.

On application of a high voltage by a generator at the terminals of the cathode and anode, a so-called anode current is established in the circuit through the generator producing the high voltage. The anode current crosses the space between the cathode and anode in the form of an electron beam which bombards the focus.

In order to obtain a high-energy electron beam, the electrons are accelerated by an intense electric field produced between the cathode and anode. For that purpose, the anode is brought to a very high positive potential in relation to the cathode. That potential can exceed 150 kV. To produce those potentials, high-voltage supply devices are used.

A part of the X-ray emission from the focus crosses the envelope and then the window of the casing. The window being of small dimensions, the cathode, anode and window have to be mounted in given relative positions that are precise and reproducible. Furthermore, the collimator is mounted outside the casing and is crossed by the X-ray beam. As a result, the position of the focus and the position of the axis of propagation of the X-ray beam, in other words, the position of the X-ray beam, have to be perfectly defined, notably, in relation to the casing. Now, the position of the point of emission or focus of the X-ray beam is determined by three translations and three rotations of the X-ray tube in relation to the casing in a three-dimensional reference. Two of the positions in translation and two of the positions in rotation are obtained by design. However, the position in translation along the axis of rotation of the anode and the position in rotation on the same axis require adjustments requiring highly skilled labor, a considerable time and tools. In particular, it often proves indispensable to carry out X-ray emissions following which the apparatus is disassembled in order to perfect the adjustment and is reassembled, and so on until obtaining the desired positioning making it possible to satisfy radiation protection standards and to obtain good-quality images. Such an apparatus is disclosed in WO A 97/44809.

BRIEF DESCRIPTION OF THE INVENTION

An embodiment of the invention is directed to an economical method of assembly of an X-ray tube for a radiology apparatus.

An embodiment of the invention is directed to a new method of assembly with positioning obtained by design.

The method of assembly, according to one aspect of the invention, is intended for a radiology apparatus X-ray emission means. The emission means comprises a casing opened by a window and an X-ray tube placed in the casing. The X-ray tube comprises an anode assembly equipped with an anode, a cathode assembly equipped with a cathode and an envelope. The anode and the cathode are placed in the envelope in order to emit an X-ray beam passing through the window. The longitudinal positioning of the X-ray tube in the casing is produced on the anode side and the angular positioning of the X-ray tube in the casing on a longitudinal axis is produced on the cathode side.

The invention is also directed to an X-ray emission device intended, for example, for a radiology apparatus. The device comprises a casing opened by a window and an X-ray tube placed in the casing. The X-ray tube comprises an anode assembly equipped with an anode, a cathode assembly equipped with a cathode and an envelope, the anode and the cathode being placed in the envelope in order to emit an X-ray beam passing through the window. The anode assembly comprises a means of longitudinal positioning of the X-ray tube in the casing and the cathode assembly comprises a means of angular positioning of the X-ray tube in the casing on a longitudinal axis.

The invention is also directed to an X-ray emission device intended for a radiology apparatus. The device comprises a casing opened by a window and an X-ray tube placed in the casing. The X-ray tube comprises an anode assembly equipped with an anode, a cathode assembly equipped with a cathode and an envelope, the anode and the cathode being placed in the envelope in order to emit an X-ray beam passing through the window. The anode assembly contains a bayonet for fastening the X-ray tube to the casing.

A radiology apparatus X-ray emission device is thus obtained, the X-ray beam of which is positioned with great precision, while being simple to assemble.

Figure 1:
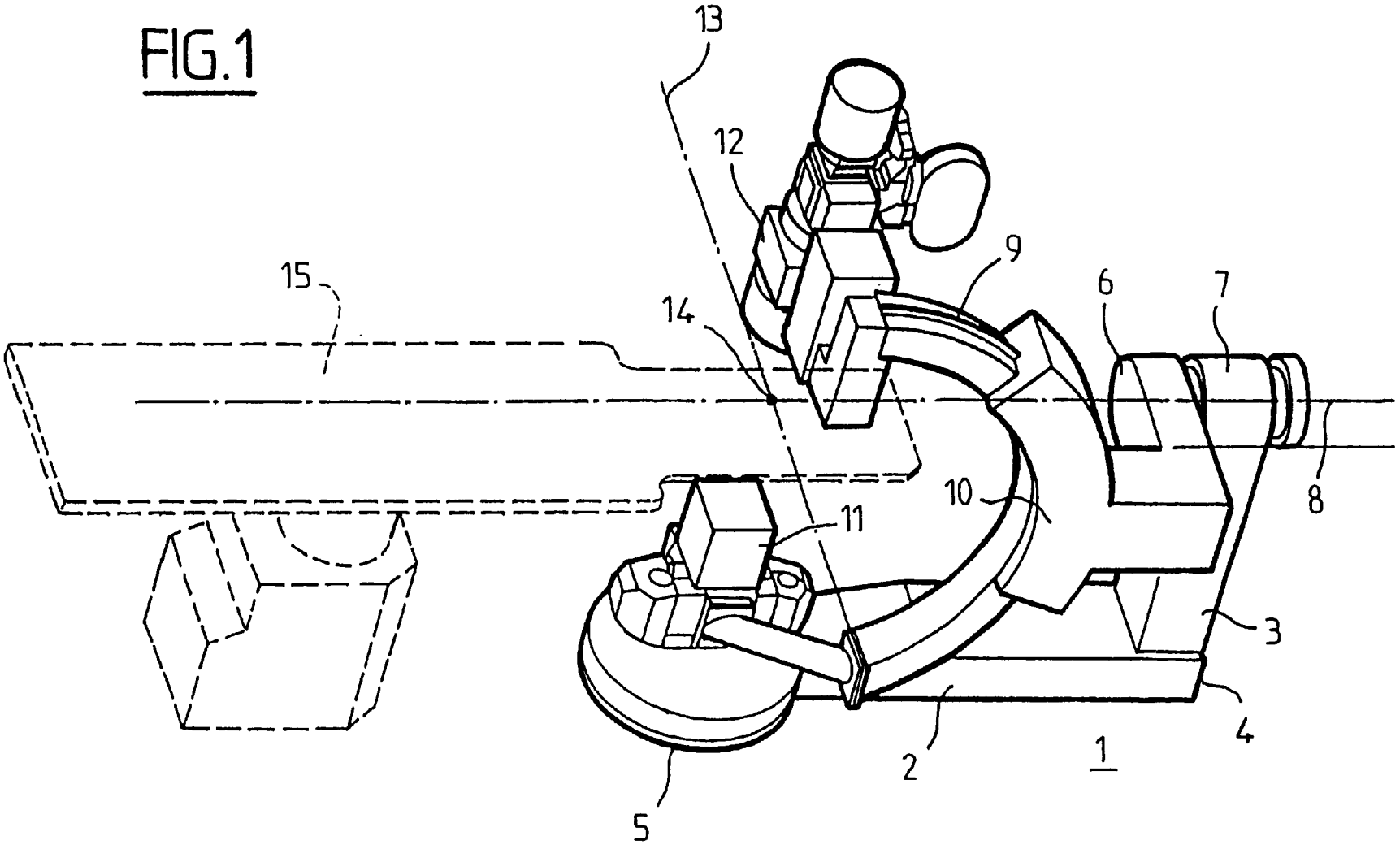
FIG. 1 is a view in perspective of a radiology apparatus with three axes, which can be used to apply the method.

The invention is generally applicable to X-ray emitters and, in particular in the medical field, to X-ray imaging devices.

DETAILED DESCRIPTION OF THE INVENTION

The anode assembly comprises an anode shaft integral with the anode, a rotation axis support and an electric drive motor of the anode equipped with a stator and a rotor, one reference surface is formed on the rotation axis support, one reference surface is formed on the casing and both reference surfaces are brought in contact.

In an embodiment of the invention the axial distance between the reference surface of the rotation axis support and the zone of the anode from which the X-ray beam is emitted is predetermined.

In an embodiment of the invention the axial distance between the reference surface of the casing and the window is predetermined.

In an embodiment of the invention rotation axis support is fastened by screwing on the casing.

In another embodiment of the invention the rotation axis support is fastened by a bayonet on the casing.

The cathode assembly comprises feed pins and crossing the envelope, the pins are fastened in an angular position predetermined in relation to the cathode, and then the cathode assembly is fixed in an angular position predetermined in relation to the casing. In an embodiment, the cathode assembly being integral with a portion of the envelope, the portion of the envelope is fastened on another portion of the envelope integral with the anode assembly, with the pins in a an angular position predetermined in relation to the casing. In an embodiment of the invention the pins are fixed in a position aligned with the cathode.

In an embodiment of the invention the cathode assembly is fixed in a position aligned with the casing.

The anode assembly generally contains a reference surface capable of cooperating by contact with a corresponding reference surface formed on the casing. The reference surface can be machined.

The cathode assembly generally contains feed pins crossing the envelope, the pins being fastened in an angular position predetermined in relation to the cathode, the cathode assembly being fixed in an angular position predetermined in relation to the casing.

In an embodiment of the invention the anode assembly comprises an anode shaft integral with the anode, a rotation axis support and an electric drive motor of the anode equipped with a stator and a rotor. One reference surface is provided on the rotation axis support, one reference surface is provided on the casing and both reference surfaces are in contact.

In an embodiment of the invention the rotation axis support contains a threaded part capable of cooperating with a corresponding part of the casing for the fastening of the axis support.

In another embodiment of the invention the rotation axis support comprises a bayonet capable of cooperating with a corresponding part of the casing for the fastening of the axis support.

The cathode assembly generally contains feed pins crossing the envelope. The pins are fastened in an angular position predetermined in relation to the cathode. The cathode assembly is fixed in an angular position predetermined in relation to the casing.

In an embodiment of the invention the cathode assembly is integral with a portion of the envelope. The portion of the envelope is fastened on another portion of the envelope integral with the anode assembly, with the pins in a an angular position predetermined in relation to the casing.

In an embodiment of the invention the pins are in a position aligned with the cathode.

In an embodiment of the invention the cathode assembly is in a position aligned with the casing.

The bayonet may comprise with a non-turning part of the anode assembly. A means complementing the bayonet, such as a ramp adapted to the bayonet, can be integrated with the casing.

As shown in FIG. 1, the radiology apparatus contains an L-shaped stand 1 with a generally horizontal base 2 and a generally vertical support 3 fastened to an end 4 of the base 2. At the opposite end 5, the base 2 contains an axis of rotation parallel to the support 3 and on which the stand is capable of turning. A support arm 6 is fastened at a first end to the top 7 of the support 3, rotating on an axis 8. The support arm 6 can take the shape of a bayonet. A C-shaped circular arm 9 is maintained by another end 10 of the support arm 6. The C-shaped arm 9 is capable of sliding rotating on an axis 13 relative to the end 10 of the support arm 6.

The C-shaped arm 9 supports an X-ray emission means 11 and an X-ray detector 12 in diametrically opposite positions facing each other. The detector 12 contains a flat detection surface. The direction of the X-ray beam is determined by a straight line joining a focal point of the emission means 11 to the center of the flat surface of the detector 12. The axis of rotation of the stand 1, the axis 8 of the support arm 6 and the axis 13 of the C-shaped arm 9 are secant at a point 14 called isocenter. In mid-position, those three axes are perpendicular to one another. The axis of the X-ray beam also passes through point 14.

A table 15, provided to accommodate a patient, possesses a longitudinal orientation aligned with axis 8 in rest position.

Figure 2:
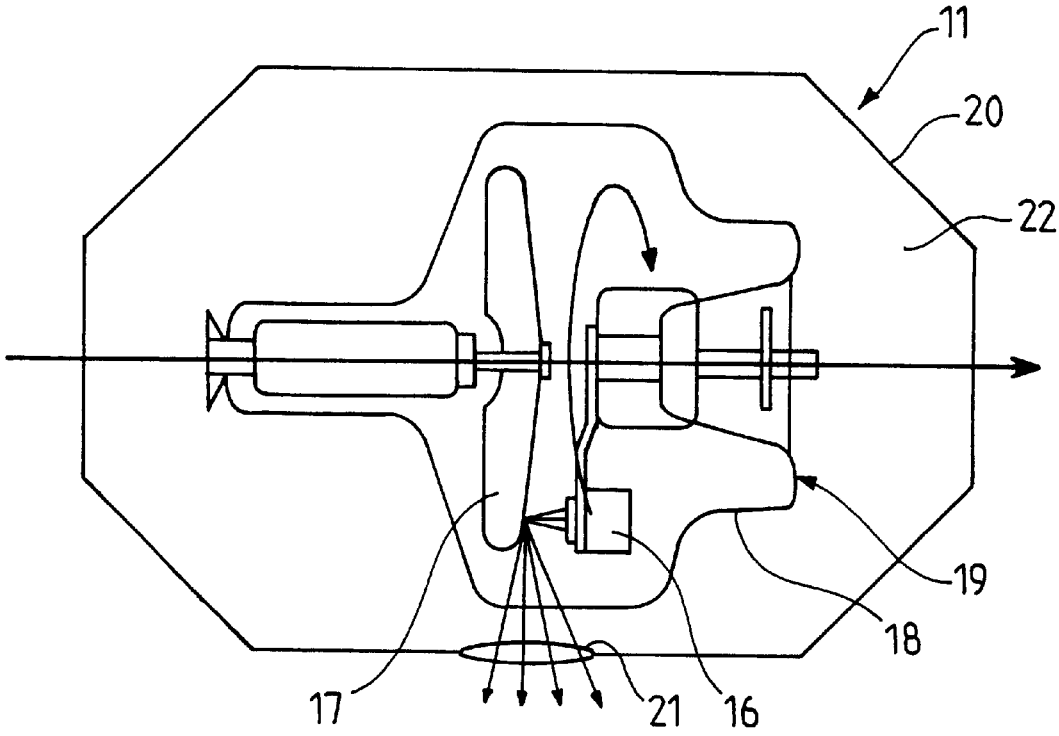
FIG. 2 is a schematic view of an X-ray tube.

As FIG. 2 shows, the X-ray emission means 11 comprises a cathode 16 and an anode 17 contained in an envelope 18 transparent to X-rays. The assembly or X-ray tube 19 consisting of the cathode 16, the anode 17 and the envelope 18 is in turn contained in a casing 20 opaque to X-rays, except for a part situated opposite the X-ray beam emitted by the anode 17, which consists of a window 21 of material transparent to X-rays. The space between the transparent envelope 18 and the opaque casing 20 is filled with oil 22 used for electric insulation and for cooling of the X-ray source.

As is well known, the cathode 16 emits an electron beam that strikes the turning anode 17, which reemits an X-radiation from a focal surface. The X-ray beam emitted by the anode 17 consists of radiation emanating from that focal surface, but also of extrafocal parasite radiations which are eliminated, preferably as close as possible to the emission source.

Figure 3:
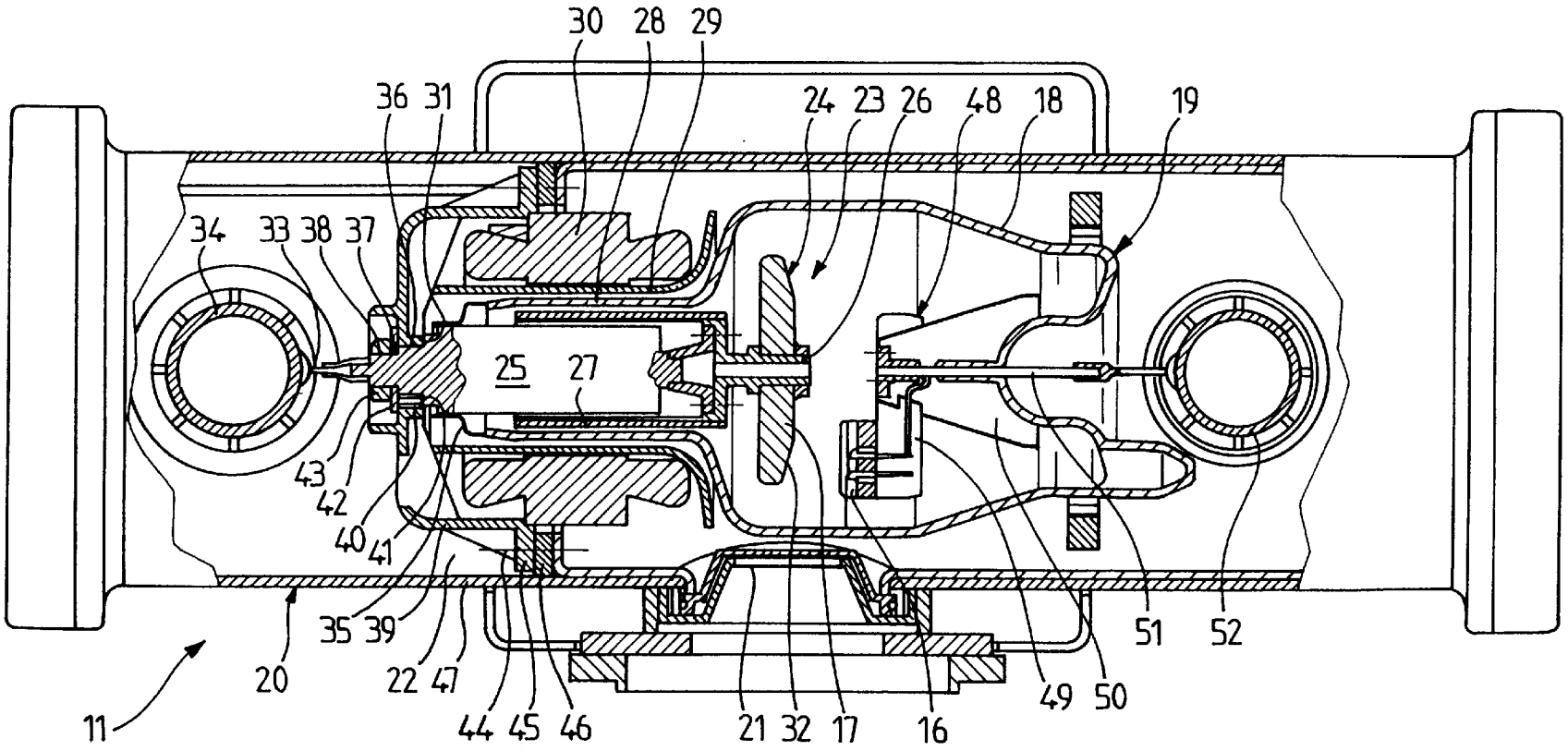
FIG. 3 is an axial section of an X-ray tube according to an embodiment of the invention.
Figure 4:
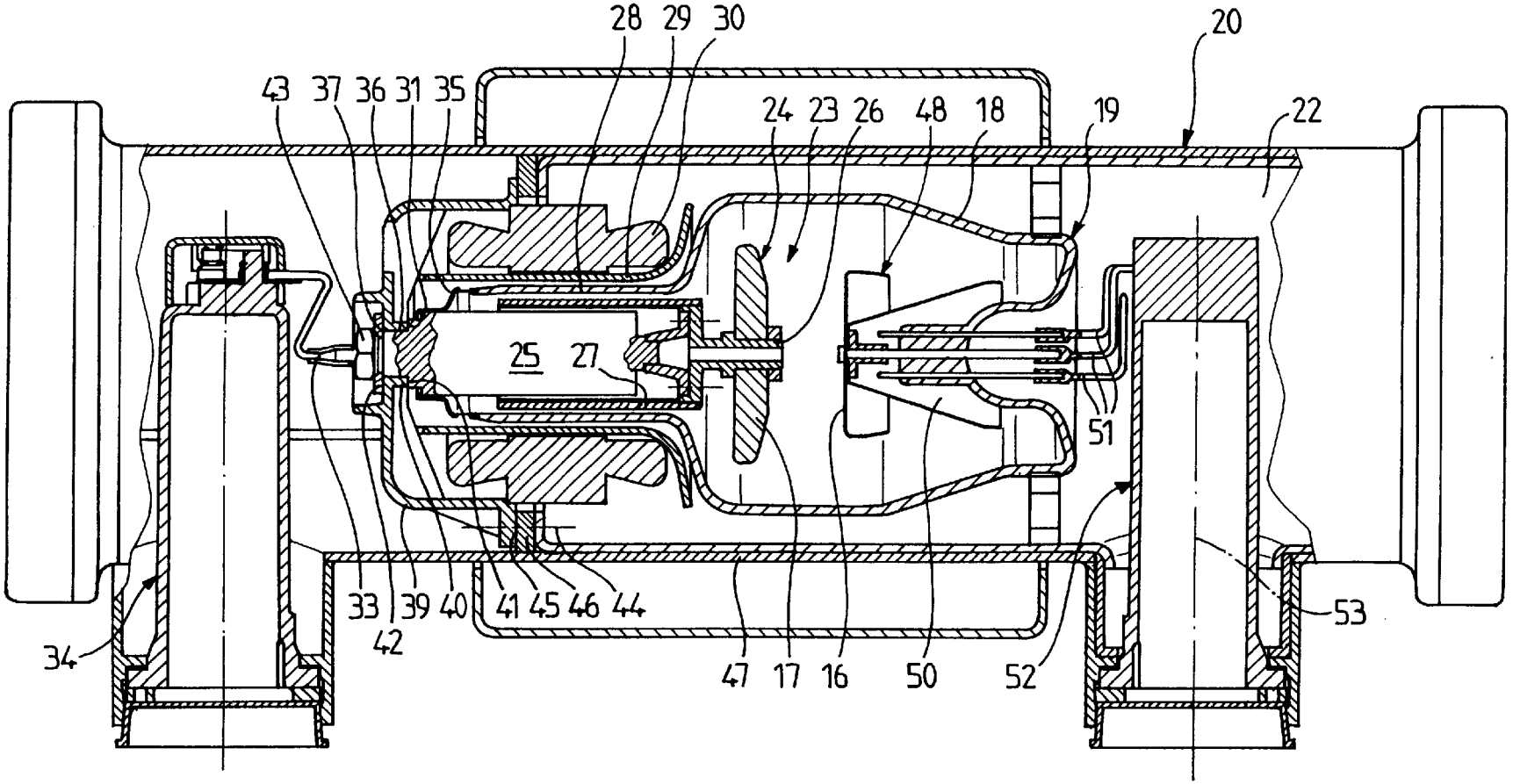
FIG. 4 is an axial view of the same X-ray tube along a cut plane perpendicular to that of FIG. 2.

More precisely, referring to FIGS. 3 and 4, the anode assembly referenced 23 comprises elements that are at the same voltage as the anode 17. The anode assembly 23 comprises a turning part 24 and of a non-turning part 25. The turning part 24 contains, in addition to the anode 17, a support shaft 26 of the anode 17 and a rotor 27, for example, of cage winding type. Roller bearings, not represented, can be provided to support the turning part 24 at high angular velocities in the order of 10,000 revolutions per minute.

The non-turning part 25 is generally cylinder-shaped and placed radially between the shaft 26 it supports and the rotor 27, placed in turn inside and at a short distance from a tubular portion 28 of the casing 18. Outside and around the tubular portion 28, an electric insulator 29 and a stator 30 are arranged. The rotor 27, the electric insulator 29 and the stator 30 form an electric motor capable of driving the anode 17. The electric insulator 29 and the stator 30 are supported by the casing 20 and are separated by a short distance from the tubular portion 28.

The non-turning part 25 is provided, at its end opposite the anode 17, with a ring-shaped reference surface 31, whose axial distance from the anode 17 and, in particular, from the X-ray emission focus 32 is determined by the manufacturing dimensions of the intermediate parts such as the shaft 26 and the bearings and known with great precision. A pin 33 is fastened to the non-turning part 25 beyond the reference surface 31. The pin 33 is in turn connected to a high-voltage supply, not represented, by means of a bushing 34 formed in the casing 20.

The tubular portion 28 of the envelope 18 ends in a collar 35, tightly fastened, for example, by welding to the non-turning part 25 in order to enable a vacuum to be maintained inside the envelope 18.

From the reference surface 31 and axially toward the pin 33, the non-turning part 25 is provided with a cylindrical surface 36 extending from the narrow diameter of the reference surface 31, with a radial surface 37 and with a threaded tubular portion 38.

The casing 20 contains a flange 39 provided with a ring-shaped tubular portion 40 of diameter adjusted to that of the cylindrical surface 36. The tubular portion 40 is provided with a radial end surface 41 forming a reference surface capable of being in contact with reference surface 31, while the threaded portion 38 projects outside the tubular portion 39 and receives a washer 42 and a nut 43.

The flange 39 is fastened by means of a plurality of screws 44 axially oriented on a radial surface 45 of a ring 46 fastened inside a tubular part 47 of the casing 20. The tubular part 47 also supports the window 21.

The axial position of reference surface 41 relative to the center of the window 21 is defined and known with great precision. Thus, the axial position of the focus 32 relative to the center of the window 21 is defined and known with great precision by design and not by adjustment with successive approximations.

The cathode assembly referenced 48 as a whole contains elements that are at the same voltage as the cathode 16. The cathode assembly 48 comprises, in addition to the cathode 16, an arm forming a cam 49 and supporting the cathode 16 and a center part 50 supporting the arm 49 and in contact with the end of the envelope 18 opposite the anode 17.

A plurality of parallel pins 51, for example, three here, tightly cross the envelope 18, being axially oriented. One of the pins can be coaxial with the shaft 26 and the other pins placed in the same plane, for example, the cut plane of FIG. 2. The pins 51 are connected to a high-voltage supply, not represented, by means of a bushing 52 formed in the casing 20.

The angular positioning of the cathode 16 relative to the longitudinal axis of the tube 19, which is also the axis of rotation of the anode 17, makes it possible to emit the X-rays properly in relation to the window 21. For that purpose, pins 51 are mounted and fastened in a given position relative to the cathode 16. In the example illustrated, the pins 51 are arranged in a plane passing through the longitudinal axis of the tube 19 and perpendicular to a plane passing through the cathode 16 and through the longitudinal axis of the tube 19. The positioning can be carried out before the final closure of the envelope 18 when it is still divided into a part integral with the pins 51 and a part integral with the collar 35. The pins 51 are then fastened to the bushing 52 in a given angular position, the bushing 51 being crosswise to the casing 20, in other words perpendicular to the longitudinal axis of the tube 19. In the example illustrated, the plane of the pins 51 passes through the axis 53 of the bushing 52. The angular position of the window 21 integral with the casing 20 is also known and defined. Consequently, the angular position of the cathode 16 is entirely and precisely defined in relation to the window 21.

Once the X-ray tube 19 is mounted and sealed, it is brought into a casing 20 equipped with the flange 39, insulator 29 and stator 30. The cylindrical surface 36 is presented and engaged in the bore of the tubular portion 40. The bushing 52 is fastened in the casing 20. Then the pins 51 are fastened to the bushing 52, thus achieving the angular positioning. The nut 43 is then tightened with the threaded portion 38, thus locking it in axial or longitudinal position.

In an alternative embodiment the nut fastening can be replaced with a bayonet-type fastening. The bayonet serves as a means of fastening on the flange 39.

Various modifications in structure and/or steps and/or function may be made by one skilled in the art without departing from the scope of the invention.

What is claimed is:

1. A method of assembly of means for X-ray emission, the means for emission comprising a casing opened by a window and an X-ray tube placed in the casing, the X-ray tube comprising an anode assembly equipped with an anode, a cathode assembly equipped with a cathode and an envelope, the anode and the cathode being placed in the envelope in order to emit an X-ray beam passing through the window, wherein the longitudinal positioning of the X-ray tube in the casing is produced on the anode side and the angular positioning of the X-ray tube in the casing on a longitudinal axis is produced on the cathode side.

2. The method according to claim 1 wherein the anode assembly comprises an anode shaft integral with the anode, a shaft support and an electric drive motor of the anode equipped with a stator and a rotor, one reference surface is formed on the rotation axis support, one reference surface is formed on the casing and both reference surfaces are brought in contact.

3. The method according to claim 2 wherein the axial distance between the reference surface of the shaft support and the zone of the anode from which the X-ray beam is emitted is predetermined.

4. The method according to claim 2 wherein the axial distance between the reference surface of the casing and the window is predetermined.

5. The method according to claim 3 wherein the axial distance between the reference surface of the casing and the window is predetermined.

6. The method according to claim 1 wherein the shaft support is fastened by screwing on the casing.

7. The method according to claim 1 wherein the shaft support is fastened by a bayonet on the casing.

8. The method according claim 1 wherein the cathode assembly containing feed pins and crossing the envelope, the pins are fastened in an angular position predetermined in relation to the cathode, and then the cathode assembly is fastened in an angular position predetermined in relation to the casing.

9. The method according to claim 8 wherein the cathode assembly is integral with a portion of the envelope, the portion of the envelope is fastened on another portion of the envelope integral with the anode assembly, with the pins in a an angular position predetermined in relation to the anode assembly.

10. The method according to claim 8 wherein the pins are fastened in a position aligned with the cathode.

11. The method according to claim 9 wherein the pins are fastened in a position aligned with the cathode.

12. The method according to claim 8 wherein the cathode assembly is fixed in a position aligned with the casing.

13. The method according to claim 9 wherein the cathode assembly is fixed in a position aligned with the casing.

14. The method according to claim 10 wherein the cathode assembly is fixed in a position aligned with the casing.

15. An X-ray emission device comprising a casing opened by a window and an X-ray tube placed in the casing, the X-ray tube comprising an anode assembly equipped with an anode, a cathode assembly equipped with a cathode and an envelope, the anode and the cathode being placed in the envelope in order to emit an X-ray beam passing through the window, the anode assembly comprising a means for longitudinal positioning of the X-ray tube in the casing and the cathode assembly comprising a means for angular positioning of the X-ray tube in the casing on a longitudinal axis.

16. A device according to claim 15 wherein the anode assembly contains a reference surface capable of cooperating by contact with a corresponding reference surface formed on the casing.

17. A device according to claim 15 wherein the cathode assembly contains feed pins crossing the envelope, the pins being fastened in an angular position predetermined in relation to the cathode, and the cathode assembly being fixed in an angular position predetermined in relation to the casing.

18. A device according to claim 16 wherein the cathode assembly contains feed pins crossing the envelope, the pins being fastened in an angular position predetermined in relation to the cathode, and the cathode assembly being fixed in an angular position predetermined in relation to the casing.

19. An X-ray emission device comprising:

a. an X-ray tube having an anode assembly with an anode and a cathode assembly with a cathode positioned within a fluid filled closed casing;

b. the casing having an X-ray transparent window;

c. the cathode assembly having means for automatically positioning the tube so that a focal spot of the tube is radially aligned with the window; and d. the anode assembly having means for automatically positioning the tube so that the focal spot is longitudinally aligned with the window.

20. The device according to claim 19 wherein the anode assembly contains a reference surface cooperating by contact with a corresponding reference surface formed on the casing.

21. The device according to claim 19 wherein the cathode assembly is fixed in a position aligned with the casing.

22. The device according to claim 19 comprising:

a. means for rotating the anode about an axis;

b. a first reference surface located on the axis; and c. a second reference surface located on the casing wherein the first and second references are in contacting relationship.

23. The device according to claim 22 wherein an axial distance between the second reference surface and the window of the casing is predetermined.

24. The device according to claim 22 wherein an axial distance between the first reference surface and a source of radiation from the anode is predetermined.

25. The device according to claim 19 comprising:

a. means for fastening the cathode assembly in an angular position predetermined in relation to the cathode; and b. means for fastening the cathode assembly in an angular position predetermined in relation to the casing.

26. The device according to claim 25 wherein the means for fastening are in a position aligned with the cathode.

27. The device according to claim 25 wherein the cathode assembly is integral with a portion of an envelope enclosing the anode and the cathode, the portion of the envelope being fastened to another portion of the envelope integral with the anode assembly.

* * * * *